US007010860B2

(12) United States Patent
Gardner et al.

(10) Patent No.: US 7,010,860 B2
(45) Date of Patent: Mar. 14, 2006

(54) HAND-HELD CUTTING DEVICE

(75) Inventors: Mark T. Gardner, deceased, late of Carl Junction, MO (US); by Cean M. Gardner, legal representative, Carl Junction, MO (US)

(73) Assignee: Alterra Holdings Corporation, Phoenix, AZ (US)

( * ) Notice: Subject to any disclaimer, the term of this patent is extended or adjusted under 35 U.S.C. 154(b) by 229 days.

(21) Appl. No.: 10/661,963

(22) Filed: Sep. 12, 2003

(65) Prior Publication Data

US 2004/0055166 A1 Mar. 25, 2004

Related U.S. Application Data

(60) Division of application No. 10/262,155, filed on Oct. 1, 2002, now Pat. No. 6,668,461, which is a division of application No. 09/536,920, filed on Mar. 28, 2000, now Pat. No. 6,484,406, which is a continuation-in-part of application No. 09/140,264, filed on Aug. 26, 1998, now Pat. No. 6,052,909.

(51) Int. Cl.
*B43L 23/00* (2006.01)

(52) U.S. Cl. ..... 30/310; 33/30.1; 33/30.6

(58) Field of Classification Search ..... 30/300, 30/310; 33/27.04, 27.03, 31, 31.1, 27.12, 33/30.1; 83/879

See application file for complete search history.

(56) References Cited

U.S. PATENT DOCUMENTS 179,039 A 6/1876 McAdams
386,619 A 7/1888 Wilson et al. ..... 33/31

(Continued)

FOREIGN PATENT DOCUMENTS

BE 864171 6/1978
BE 903666 3/1986

(Continued)

OTHER PUBLICATIONS

Ellipsographs of De l'Hospital, http://155.185.1.61/labmat/hospltin.htm, p. 1 of 1, Jun. 5, 2000.

(Continued)

*Primary Examiner*—Douglas D Watts
(74) *Attorney, Agent, or Firm*—Foley & Lardner LLP

(57) ABSTRACT

A cutting device is operable with one hand for cutting a circle or an elliptical shape in a sheet of material. In a first embodiment for cutting elliptical shapes, the cutting device includes a first member for placement on the sheet material and a second member for simultaneous pivotal and translatable movement with respect to the base plate. The first member has a first pivot point that is movable along a first axis, while the second member has a second pivot point that is movable along a second axis substantially perpendicular to the first axis. The first and second members are operably connected to each other at the first and second pivot points. A knob is connected to one of the pivot points and is sized to be grasped by one hand and rotated. Rotation of the knob about the one pivot point causes the second member to rotate and slide in an elliptical pattern with respect to the base plate. The second member may include or may be coupled to a forming member to thereby form an elliptical shape in the sheet of material. In a second embodiment the cutting device has a first member for placement on the sheet of material and a second member for pivotal movement with respect to the first member. The first member includes a single pivot point. A knob is placed substantially over the single pivot point, and rotation of the knob causes the second member to pivot about the single pivot point, thereby forming a circle in the sheet of material.

16 Claims, 15 Drawing Sheets

U.S. PATENT DOCUMENTS

| | | | | |
|---|---|---|---|---|
| 494,864 | A | 4/1893 | Huston | |
| 517,522 | A | 4/1894 | King | 33/31 |
| 572,320 | A | 12/1896 | Stuparich | |
| 658,710 | A | 9/1900 | Forker | |
| 658,711 | A | 9/1900 | Forker | |
| 660,211 | A | 10/1900 | Durkel | |
| 697,997 | A | 6/1902 | Drinkous | |
| 701,828 | A | 6/1902 | Arnold | |
| 705,576 | A | 7/1902 | Forker | |
| 742,047 | A | 10/1903 | Moehle | |
| 922,819 | A * | 5/1909 | Springer | 27/5 |
| 973,047 | A | 10/1910 | Jeter | 33/31 |
| 1,007,910 | A | 11/1911 | Dakel | |
| 1,010,292 | A | 11/1911 | McKinstry | 33/31 |
| 1,031,780 | A | 7/1912 | Fine | 33/31 |
| 1,326,260 | A | 12/1919 | Hardebeck | |
| 1,391,530 | A | 9/1921 | Bustillo y Diego | |
| 1,470,168 | A | 10/1923 | Jepsen | 33/31 |
| 1,614,772 | A | 1/1927 | Bambini et al. | |
| 1,806,484 | A | 5/1931 | Michaud | |
| 1,837,912 | A | 12/1931 | Mann | 33/31 |
| 2,215,216 | A | 9/1940 | Gits et al. | 30/162 |
| 2,458,208 | A | 1/1949 | Ruger | 33/31 |
| 2,494,557 | A | 1/1950 | Irick | 33/31 |
| 2,512,786 | A | 6/1950 | Borg | 33/27 |
| 2,790,240 | A | 4/1957 | Silverstein | |
| 2,872,732 | A | 2/1959 | Arrowood | 30/314 |
| 2,908,972 | A | 10/1959 | Nitenson | 30/293 |
| 2,925,655 | A | 2/1960 | De Beek | 33/31 |
| 3,032,893 | A | 5/1962 | Debeh | 35/13 |
| 3,165,130 | A | 1/1965 | Sanders | 144/33 |
| 3,562,915 | A | 2/1971 | Brown | 33/31 |
| 3,576,148 | A | 4/1971 | Katz | |
| 3,621,574 | A | 11/1971 | Yanke et al. | |
| 3,787,968 | A | 1/1974 | Littmann | |
| 3,820,245 | A | 6/1974 | Yozzo | 33/27 |
| 3,845,676 | A | 11/1974 | Pierce | |
| 3,867,636 | A | 2/1975 | Miyahara | 250/445 |
| D243,117 | S | 1/1977 | Green | D15/127 |
| 4,048,724 | A | 9/1977 | Keuver | |
| 4,057,898 | A | 11/1977 | Piosky | |
| 4,112,793 | A | 9/1978 | Pierce | |
| 4,148,144 | A | 4/1979 | Stiles | 33/33 |
| 4,176,452 | A | 12/1979 | Duggins et al. | |
| 4,222,169 | A | 9/1980 | Lockwood | 30/286 |
| 4,233,736 | A | 11/1980 | Duggins et al. | 30/293 |
| 4,244,106 | A | 1/1981 | Pierce | |
| 4,306,598 | A | 12/1981 | Peot | 144/136 |
| 4,407,074 | A | 10/1983 | Ledbetter | 33/27 |
| 4,426,781 | A | 1/1984 | Kufrin | |
| 4,445,275 | A | 5/1984 | Dubrow | 33/30 |
| 4,567,927 | A | 2/1986 | Plamann | |
| 4,624,057 | A | 11/1986 | Hursey | 33/570 |
| 4,649,647 | A | 3/1987 | Kaulfuss | 30/293 |
| 4,691,604 | A | 9/1987 | Carmichael | |
| 4,773,798 | A | 9/1988 | Gaster et al. | 408/102 |
| 4,782,730 | A | 11/1988 | Picone et al. | 83/745 |
| 4,790,222 | A | 12/1988 | Morgan | 82/1.3 |
| 4,858,322 | A | 8/1989 | Kluga | 30/310 |
| 4,934,054 | A | 6/1990 | Morozumi | 30/293 |
| 5,014,584 | A | 5/1991 | Kozyrski et al. | 83/464 |
| 5,099,727 | A | 3/1992 | Kozyrski et al. | |
| 5,123,170 | A | 6/1992 | Enrique | |
| 5,189,800 | A | 3/1993 | Morita et al. | |
| 5,233,748 | A | 8/1993 | Logan et al. | |
| 5,253,421 | A * | 10/1993 | Landmark | 33/27.03 |
| 5,322,001 | A | 6/1994 | Boda | |
| 5,430,946 | A | 7/1995 | Peters et al. | 33/31 |
| 5,526,573 | A | 6/1996 | Peters et al. | |
| 5,555,631 | A | 9/1996 | Houston | 33/31 |
| 5,671,647 | A | 9/1997 | Mori | |
| 5,802,942 | A | 9/1998 | Cornell et al. | |
| 6,052,909 | A | 4/2000 | Gardner | 30/310 |
| 6,158,133 | A | 12/2000 | Carlson et al. | 32/27.01 |
| 6,484,406 | B1 | 11/2002 | Gardner | |

FOREIGN PATENT DOCUMENTS

| | | |
|---|---|---|
| CA | 2250561 | 7/1999 |
| CN | 1209394 | 3/1999 |
| DE | 1265398 | 4/1968 |
| DE | 81840 | 5/1971 |
| DE | 2511081 | 9/1976 |
| DE | 2522188 | 11/1976 |
| DE | 2621687 | 12/1977 |
| DE | 2621687 | 5/1978 |
| DE | 2815383 | 10/1979 |
| DE | 3235823 | 5/1983 |
| DE | 3343370 | 5/1984 |
| DE | 3837449 | 5/1985 |
| DE | 3923785 | 1/1991 |
| DE | 29707792 | 8/1997 |
| EP | 0410058 | 1/1991 |
| EP | 733434 | 9/1996 |
| EP | 955133 | 11/1999 |
| EP | 979700 | 2/2000 |
| FR | 2441468 | 6/1980 |
| FR | 2612113 | 9/1988 |
| GB | 979278 | 1/1965 |
| GB | 1581097 | 2/1978 |
| GB | 2075405 | 11/1981 |
| GB | 2242147 | 9/1991 |
| GB | 2297526 | 8/1996 |
| JP | 47-19474 | 7/1972 |
| JP | 48-4123 | 1/1973 |
| JP | 48-58260 | 8/1973 |
| JP | 4921232 | 2/1974 |
| JP | 50-23336 | 8/1975 |
| JP | 51-8152 | 1/1976 |
| JP | 53-119132 | 10/1978 |
| JP | 53-124391 | 10/1978 |
| JP | 54-38466 | 3/1979 |
| JP | 54-60028 | 5/1979 |
| JP | 55-20094 | 5/1980 |
| JP | 55-146800 | 11/1980 |
| JP | 58172240 | 10/1983 |
| JP | 60-53592 | 4/1985 |
| JP | 61-32800 | 2/1986 |
| JP | 61-83987 | 6/1986 |
| JP | 61-226297 | 10/1986 |
| JP | 62-60699 | 3/1987 |
| JP | 1-106296 | 7/1989 |
| JP | 02293200 | 12/1990 |
| JP | 03101999 | 4/1991 |
| JP | 03244600 | 10/1991 |
| JP | 04164698 | 6/1992 |
| JP | 6-88478 | 11/1994 |
| JP | 7-80390 | 8/1995 |
| JP | 08090988 | 4/1996 |
| JP | 2552913 | 8/1996 |
| JP | 09300274 | 11/1997 |
| JP | 10035182 | 2/1998 |
| RU | 2038926 | 7/1995 |
| RU | 2066599 | 9/1996 |
| RU | 2112630 | 6/1998 |
| SU | 547362 | 2/1977 |
| SU | 640788 | 1/1979 |
| SU | 742397 | 6/1980 |
| SU | 946815 | 7/1982 |
| SU | 992439 | 1/1983 |
| SU | 1282987 | 1/1987 |

OTHER PUBLICATIONS

Ellipsograph of Van Schooten, http://155.185.1.61/labmat/Vanschin.htm, p. 1 of 1, Jun. 5, 2000.

The Fletcher–Terry Company, Product Book, 26 Pages.

Delphion Intellectual Property Network, Jul. 6, 2000, 3 pages, http://www.patents.ibm.com/details?pn=JP02293200A2.

Delphion Intellectual Property Network, Jul. 6, 2000, 3 pages, http://www.patents.ibm.com/details?pn=JP01308698A2.

Delphion Intellectual Property Network, Jul. 6, 2000, 3 pages, JP4369600.http://www.patents.ibm.com/details?pn=JP04369600A2.

Delphion Intellectual Property Network, Jul. 6, 2000, 3 pages, http://www.patents.ibm.com/details?pn=JP08257802A2.

"What Can You Do With A Doodle Cutter?", Creating Keepsakes, Jul.–Aug. 1999.

Instructions for Doodle Cutter, Minx, Inc., Jul. 21, 2000.

Coluzzle Collage Template System, California East, Ltd., Feb. 1999.

Nested Templates, California East, Ltd., May 1998.

* cited by examiner

HAND-HELD CUTTING DEVICE

CROSS-REFERENCE TO RELATED PATENT APPLICATIONS

This application is a divisional of U.S. patent application Ser. No. 10/262,155, filed Oct. 1, 2002 now U.S. Pat. No. 6,668,461, which is a divisional of U.S. patent application Ser. No. 09/536,920, filed Mar. 28, 2000, now U.S. Pat. No. 6,484,406, which is a continuation-in-part of U.S. patent application Ser. No. 09/140,264, filed Aug. 26, 1998, now U.S. Pat. No. 6,052,909. The application, including the specification, drawings, claims and abstract, is incorporated herein by reference in its entirety.

BACKGROUND OF THE INVENTION

1. Field of the Invention

This invention relates to cutting devices, and more particularly to a device for cutting circles or ellipses of variable sizes in photographs, sheets, mats, and the like.

2. Description of the Related Art

Various different devices for cutting shapes in a sheet of material are known in the art. Circle cutters and elliptical cutting devices have become popular, especially by those who create "memory books" by cutting photographs and borders to desired shapes to enhance the display of photographs. Known devices generally require two-handed operation, with one hand holding the base of the device in a fixed position, while the other hand moves a cutting arm around the base. During the course of a cutting operation, one of the arms and/or hands of the user will invariably block another of the arms and/or hands since one hand is usually held stationary while the other hand moves a cutting arm. This type of interference can produce results that are below expectations since the cutting operation must be stopped, the moving hand repositioned under the interfering arm, and the cutting operation restarted. Many variables are introduced into the cutting operation during hand repositioning, such as uneven or inconsistent pressure applied to the cutting device from one or both hands, leaning or inadvertent moving of the device, etc. Thus, these types of devices are difficult to manipulate and maintain accurate and consistent cuts.

In addition, many prior art cutting devices are primarily designed to cut out a shape in a cardboard mat or the like, where the inside of the shape is usually discarded after the cut. Such devices are typically hand-held and include one or more pins that pierce the oval area for securing a base portion of the device against movement with respect to the mat during cutting. This type of arrangement is not suitable when the sheet of material cannot be damaged, such as when a person desires to cut a photograph in a circular or oval shape.

SUMMARY OF THE INVENTION

These and other problems of the prior art are overcome by the provision of a hand-held device that is operable with one hand for forming a circular or an elliptical shape in a sheet of material without damaging the sheet of material. In a first embodiment for cutting elliptical shapes, the cutting device includes a first member for placement on the sheet material and a second member for simultaneous pivotal and translatable movement with respect to the base plate. The first member has a first pivot point that is movable along a first axis, while the second member has a second pivot point that is movable along a second axis substantially perpendicular to the first axis. The first and second members are operably connected to each other at the first and second pivot points. A knob is connected to one of the pivot points and is sized to be grasped by one hand and rotated. Rotation of the knob about the one pivot point causes the second member to rotate and slide in an elliptical pattern with respect to the base plate. The second member may include or may be coupled to a forming member to thereby form an elliptical shape in the sheet of material. In a second embodiment for cutting circular shapes, the cutting device has a first member for placement on the sheet of material and a second member for pivotal movement with respect to the first member. The first member includes a single pivot point. A knob is placed substantially over the single pivot point, and rotation of the knob causes the second member to pivot about the single pivot point, thereby forming a circle in the sheet of material.

BRIEF DESCRIPTION OF THE DRAWINGS

The preferred embodiments of the present invention will hereinafter be described in conjunction with the appended drawings, wherein like designations denote like elements, and.

DETAILED DESCRIPTION OF THE PREFERRED EMBODIMENTS

Figure 1A:
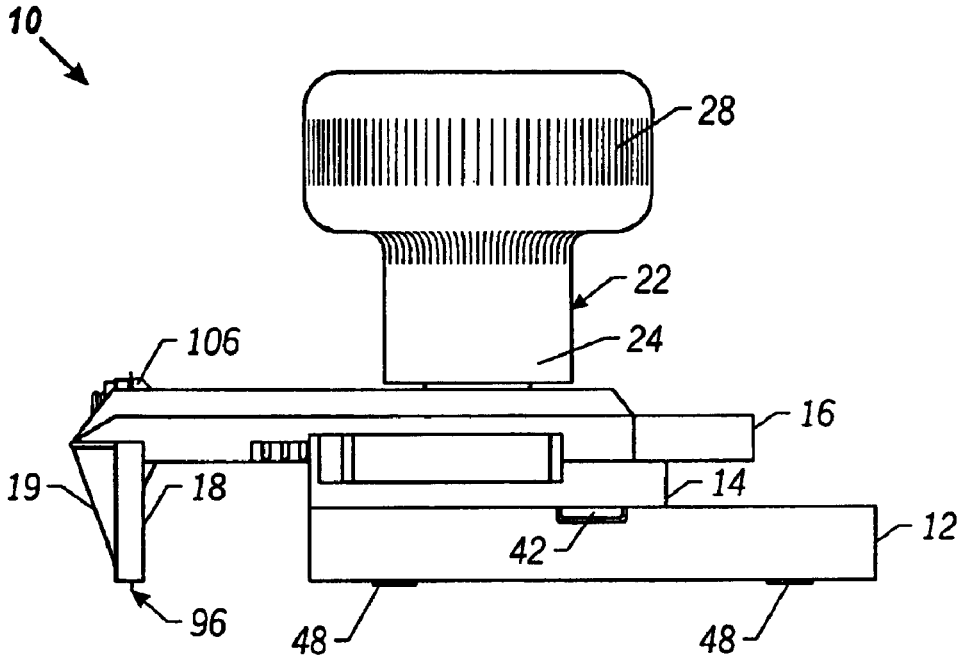
FIGS. 1A, 1B, 2A and 2B are each side elevational views of a hand-held oval cutting device according to a first embodiment of the invention.
Figure 1B:
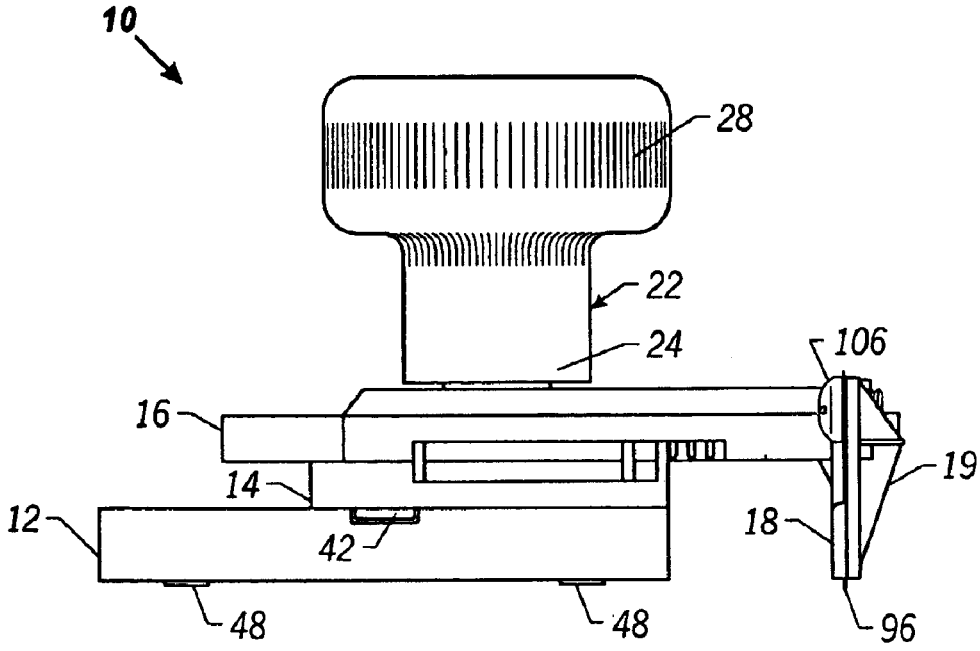
Figure 2A:
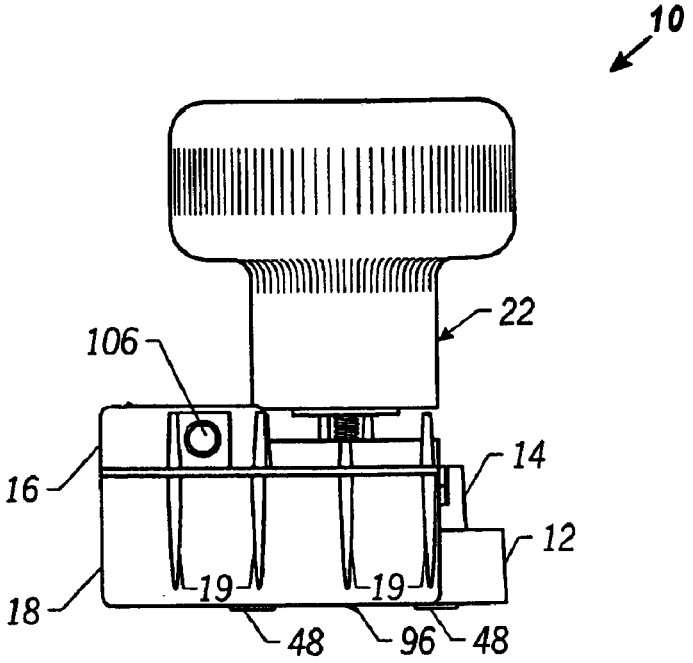
Figure 2B:
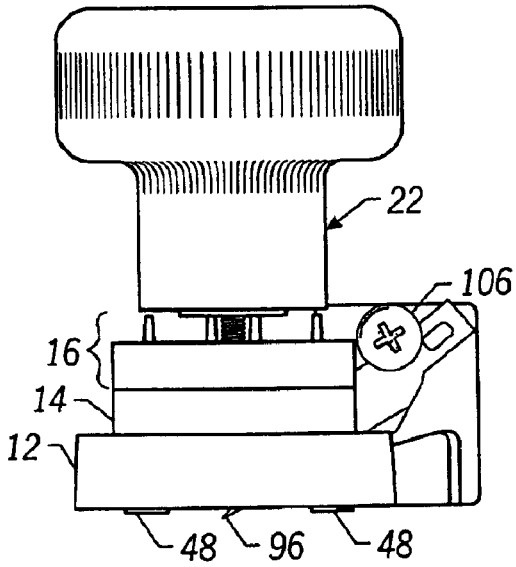

The presented invention is presented herein by way of example in two specific embodiments. The features of an oval cutting device according to the first embodiment is discussed herein with reference to FIGS. 1–20. A circular cutting device according to the second embodiment is discussed herein with reference to FIGS. 21–22. Note that these preferred embodiments are presented as examples of suitable implementations in accordance with the present invention, and other variations are possible within the scope of the present invention.

Referring now to the drawings, and to FIGS. 1–4 in particular, a hand-held oval cutting device 10 comprises a base plate 12 pivotally connected to a spacer block 14 and an adjusting plate 16. Adjusting plate 16 includes a blade holder 18. An elongate machine screw 20 or other suitable fastener has a head portion 54 and a threaded shaft portion 26. The shaft portion 26 extends through the base plate 12, the spacer block 14, and the adjusting plate 16. A knob 22 includes a lower stem portion 24 that includes an internally threaded portion for receiving an upper end portion of the threaded shaft 26 for holding the base plate, spacer block, and adjusting plate together. An upper handle portion 28 of the knob 22 is adapted to be grasped and manipulated by one hand of a user.

Figure 4:
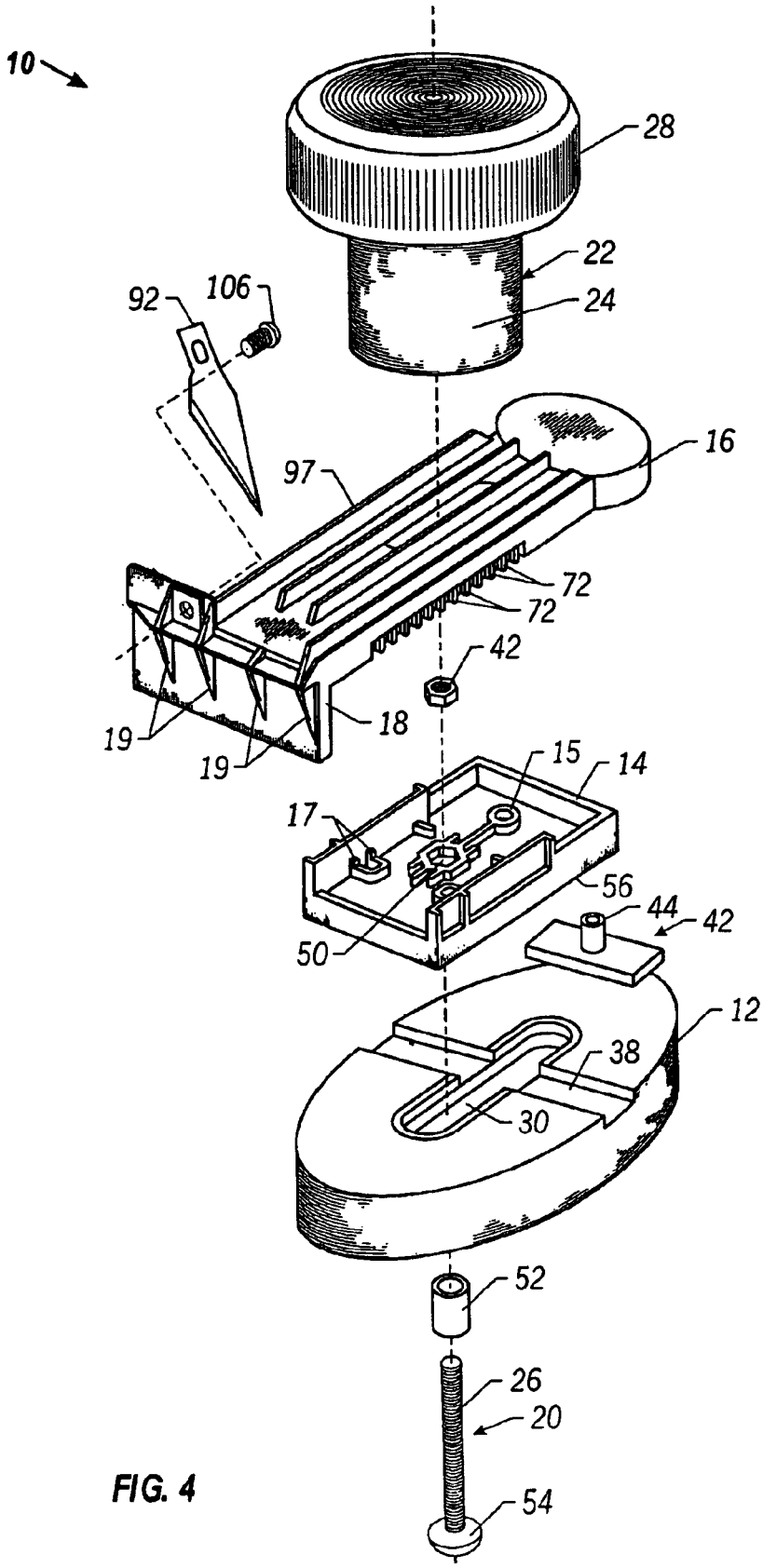
FIG. 4 is an exploded perspective view of the hand-held oval cutting device of FIGS. 1 and 2.
Figure 5:
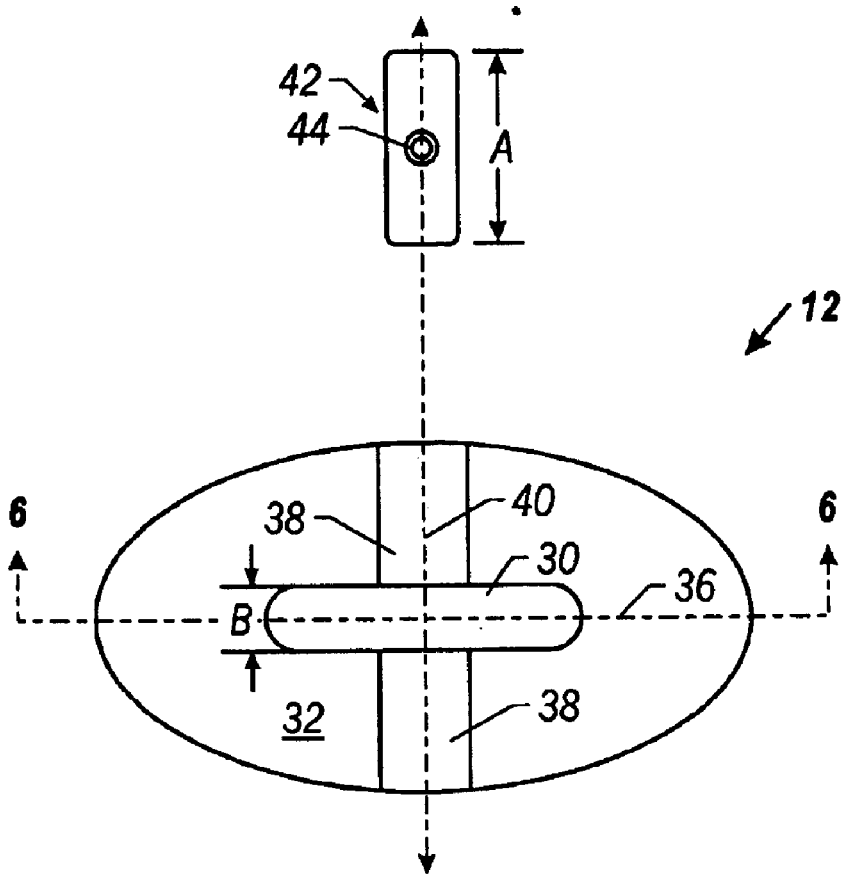
FIG. 5 is a top plan view of a base plate and slider block according to the first embodiment of the invention.
Figure 6:
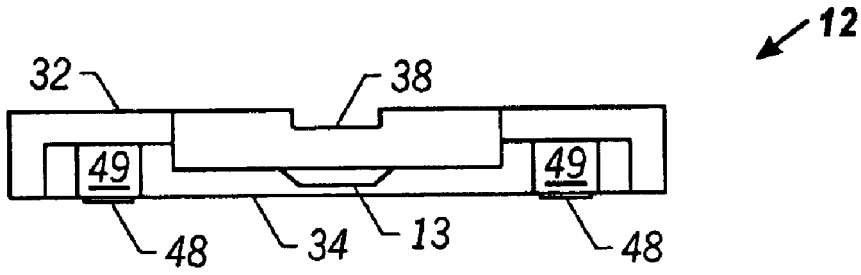
FIG. 6 is a cross sectional view of the base plate taken along line 6—6 of FIG. 5.

As shown in FIGS. 4–6, in a first embodiment of the invention, base plate 12 is preferably elliptical in shape. A slot 30 extends through the base plate 12. The slot 30 preferably lies along a major axis 36 of the ellipse. A channel 38 is formed in the upper surface 32 of the base plate 12 and preferably extends along a minor axis 40 of the ellipse, intersecting the slot 30 in a substantially perpendicular orientation.

A slider block 42 is dimensioned to be slidably received in the channel 38 with a length "A" that is preferably longer than a width "B" of the slot 30. An extended portion 44 extends from the slider block 42 and is adapted to be received into an aperture 15 on the spacer block 14, as shown in FIG. 4. The extended portion 44 of slider block 42 constrains movement of the slider block within the channel 38 when the spacer block 14 is rotated with respect to the base plate 12, pivoting the slider block 42 about the pivot point defined by aperture 15.

Figure 3:
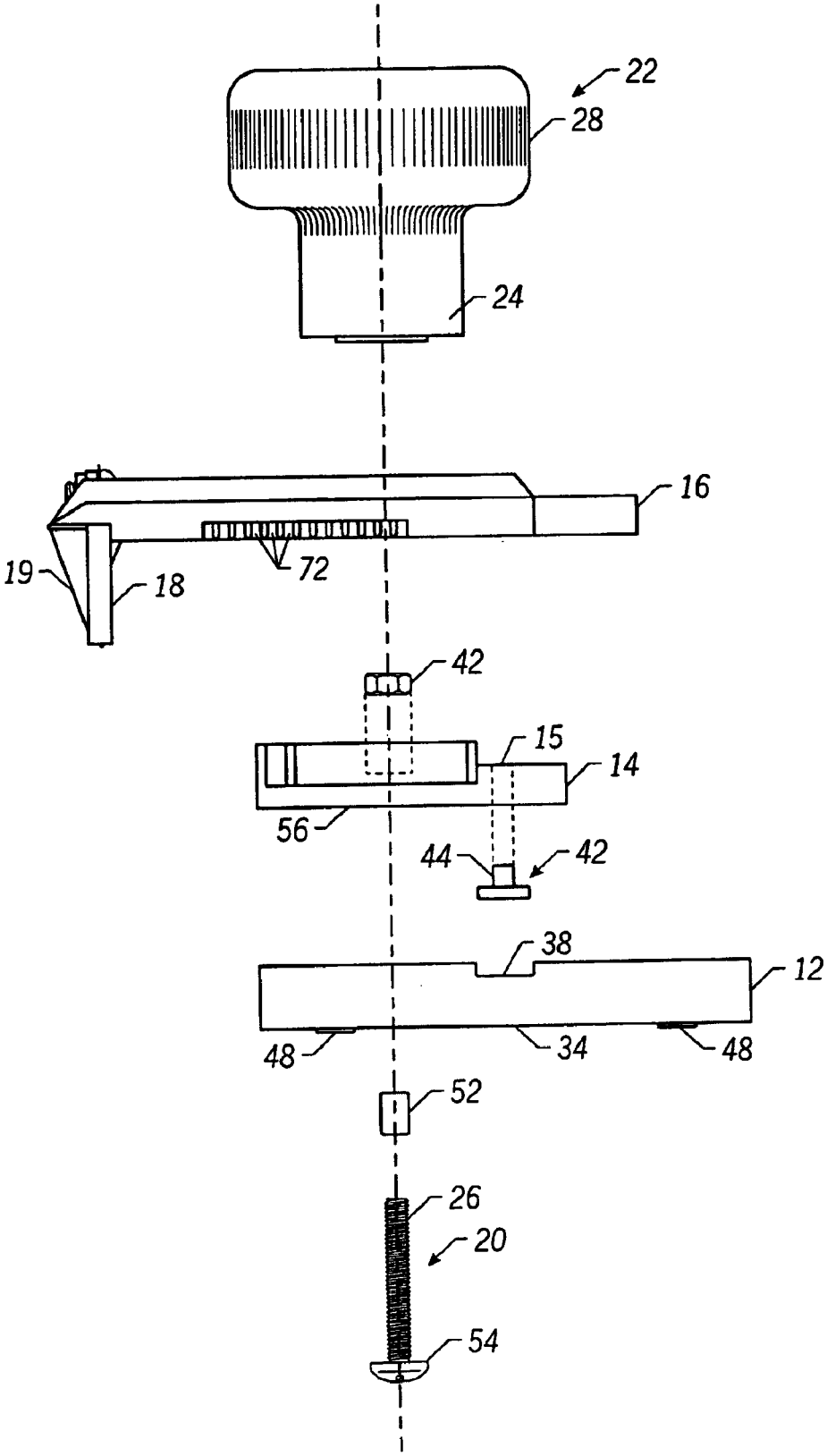
FIG. 3 is an exploded side view of the hand-held oval cutting device of FIGS. 1 and 2.

As shown in FIGS. 3 and 6, a plurality of resilient feet 48 are attached to the lower surface 34 of the base plate 12, preferably through an adhesive layer, but may alternatively be attached by suitable fasteners, ultrasonic welding, or other well-known means. The resilient feet are arranged so as to firmly grip the surface of a sheet material during cutting. In the specific configuration shown in FIG. 6, resilient feet 48 are mounted to feet 49 that extend downward from the top surface 32 of base plate 12. Note also that base plate 12 suitably includes one or more stiffening ribs 13 that provide the required strength for performing a cutting operation without undue flexing.

As used herein, the terms "forward," "rearward," "upper," and "lower" and other directional terms are indicative of relative, not absolute orientations or positions. Preferably, the cutting device is constructed of clear plastic material, with the exception of the knob 22 which may be constructed of nylon or the like.

Figure 9:
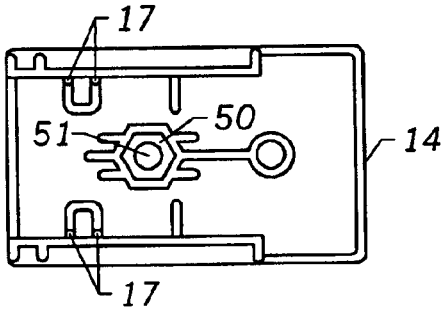
FIG. 9 is a top plan view of a spacer block according to the first embodiment of the invention.
Figure 10:
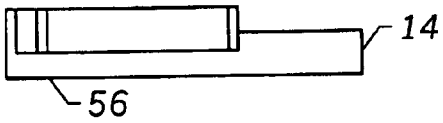
FIG. 10 is a side view of the spacer block of FIG. 9.

With emphasis on FIGS. 4 and 9, the spacer block 14 includes a hexagonal recess 50 that receives a nut 42 that engages the threads of the fastener 20 to mount the spacer block 14 to the base plate 12. Hexagonal recess 50 includes a bottom portion with a hole 51 that is dimensioned to receive the threaded shaft 26 of fastener 20, while holding nut 42 in place. A spacer 52 is received in the slot 30 between the head 54 of the fastener 20 and a lower surface 56 of the spacer block 14, and is dimensioned to slide freely in the slot 30. The shaft 26 of the fastener 20 extends through the spacer 52, while the head portion 54 is larger than the spacer and larger than the width "B" of slot 30. Preferably, the height of the spacer 52 is slightly greater than the thickest portion of slot 30 in base plate 12 such that the head 54 is located within a lower recess defined within base plate 12 to minimize friction during pivoting and sliding movements of the adjusting plate and spacer block with respect to the base plate. As shown in the figures, the preferred configuration for spacer 52 is a bushing that has an inside diameter large enough to allow threaded shaft 26 of fastener 20 to slide through it, has an outside dimension smaller than the width of slot 30 in base plate 12, and has a height greater than the depth of slot 30. With the hold 51 in the hexagonal recess being smaller than the outside diameter of the bushing 52, the upper surface of bushing 52 will rest upon the lower surface of spacer block 14, thereby allowing the spacer block 14 to slide and rotate atop the base plate 12.

Note that the screw 20 and bushing 52 are only examples of a suitable connecting mechanism within the scope of the preferred embodiments. Many other mechanisms may be used to couple spacer block 14 to base plate. For example, spacer block 14 may have a screw coupled to it with a head portion on the upper portion of the spacer block 14 and a nut on the threaded portion 26 below base plate 12 that captivates the base plate 12 to the spacer block 14. In another example, spacer block 14 may have another portion, such as a metal or plastic rod, that extends downward through slot 30. A push nut could then be placed on the rod at the appropriate position to captivate the spacer block 14 and the base block 12 together. These and other variations are expressly within the scope of the preferred embodiments, which extend to any suitable connecting mechanism for coupling a first member, such as base plate 12, to a second member, such as spacer block 14, in a manner that allows the second member to slide atop the first member when the first member is placed on a sheet of material.

Spacer block 14 includes multiple portions 17 that extend upward to engage recessed portions 72 of adjusting plate 16. The position of adjusting plate 16 with respect to spacer block 14 may be adjusted by moving the adjusting plate 16 so that different recessed portions 72 engage the multiple extended portions 17 of the spacer block. In this manner the distance between the blade holder 18 and the spacer block can be varied to allow cutting different sizes of shapes.

Figure 7:
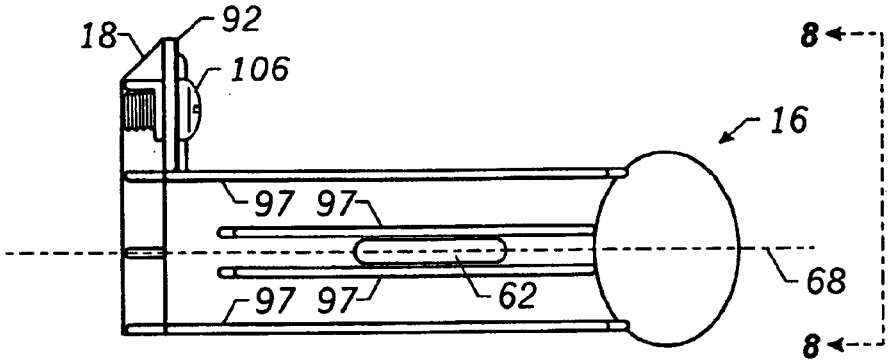
FIG. 7 is a top plan view of an adjusting plate according to the first embodiment of the invention.

With reference now to FIG. 7, a slot 62 extends through the adjusting plate 16. The slot 62 preferably lies along a longitudinal axis 68 of the plate 16. The plurality of recessed portions 72 are formed in the lower surface of the adjusting plate 16, and are preferably formed on both sides of the adjusting plate 16, extending parallel to slot 62. Adjusting plate 16 preferably includes a plurality of stiffening ribs 97 that provide the strength needed to perform the cutting action without undue flexing.

Figure 8:
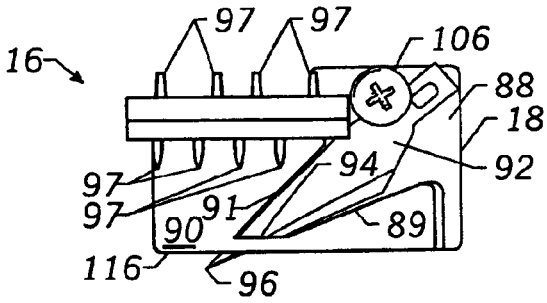
FIG. 8 is an end view of the adjusting plate of FIG. 7 taken along line 8—8 of FIG. 7.

As shown in FIG. 8, adjusting plate 16 includes a blade holder 18 that has a recess 88 for receiving a cutting blade formed in the rear surface 90 of the holder 18. The recess 88 has a lower side wall 89, an upper side wall 91, and a lower edge 94 that together define edges of the recess 88. The recess 88 is shaped to receive a standard razor-type cutting blade 92. Blades manufactured under the trade name X-ACTOθ, for example, would be suitable. Preferably, the depth of the recess 88 is greater than or equal to the thickness of the blade 92 in order to shield as much of the blade as possible from a user. The bottom edge of recess 88 includes a slot 95, best shown in FIG. 12, through which the tip 96 of blade 92 extends. A screw 106 is used to captivate the blade 92 within recess 88 once the blade is properly positioned. In the preferred embodiments, a user can easily assure proper position of the blade by first loosening the screw 106, pushing the tip 96 of blade 92 through slot 95 until the blade will not move any more because it is contacting one or both edges 89 and 91 of recess 88, and tightening screw 106 to hold blade 92 in place. Once installed, the cutting tip 96 of the blade 92 extends a predetermined distance below a lower surface 116 of the blade holder 18 for cutting materials of a predetermined thickness. It will be understood of course, that the 20 predetermined distance may be adjustable to accommodate different material thicknesses.

Although it is preferred that the blade holder 18 and blade 92 extend substantially perpendicular from the top portion of adjusting member 16, there may be some instances where it is desirous to cut a beveled surface. In this case, the blade holder and/or adjusting member may be modified to position the blade at an angle with respect to a surface of the sheet material to be cut.

As shown most clearly in FIG. 4, blade holder 18 includes one or more stiffening ribs 19 that provide strength to blade holder 18 while reducing the amount of material required to fabricate blade holder 18. Stiffening ribs 19 provide the required strength to blade holder 18 to perform a cutting operation without undue flexing.

Adjusting plate 16 preferably include one or more stiffening ribs 97 that preferably run parallel to the longitudinal axis 68 of adjusting plate 16. These stiffening ribs 97 allow the thickness of adjusting plate 16 to be kept to a minimum, thereby conserving the plastic material used to form adjusting plate 16, while still providing the desired strength that allows the cutting device 10 to operate dependably.

Referring again to FIGS. 3 and 4, the oval cutting device 10 can be adjusted to cut different sizes of ovals by first loosening the knob 22, lifting the adjusting plate 16 until the extended portions 17 are clear of their respective recessed portions 72 in adjusting plate 16, sliding the adjusting plate forward or rearward until the extended portions 17 are in alignment with a new set of recessed portions 72, and then retightening the knob 22 with the adjusting plate in the new position. Since the fastener 20 is also threaded through a nut that is captivated into the spacer block 14, the spacer block remains together with the base plate 12 when the knob 22 is removed. Note that even when the knob is not present, pivoting and sliding movement between the spacer block and base plate may occur. While the preferred embodiment has spacer block 14 and adjusting arm 16 as separate pieces, it is equally within the scope of the preferred embodiments to form a spacer block 14 that includes an extended arm and blade holder for cutting ellipses of a fixed size, rather than providing a two-piece system that allows adjustment of the size of the ellipse. The preferred embodiments expressly extend to any configuration of forming member, whether integrated into the spacer block or provided separate from the spacer block.

Figure 11:
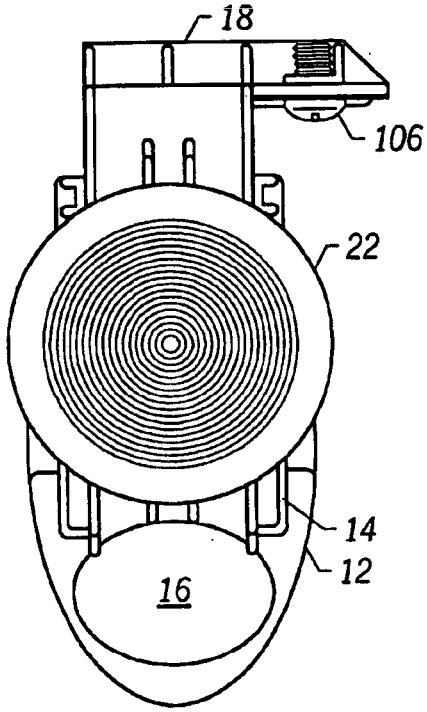
FIG. 11 is a top plan view of the cutting device of FIGS. 1 and 2.
Figure 12:
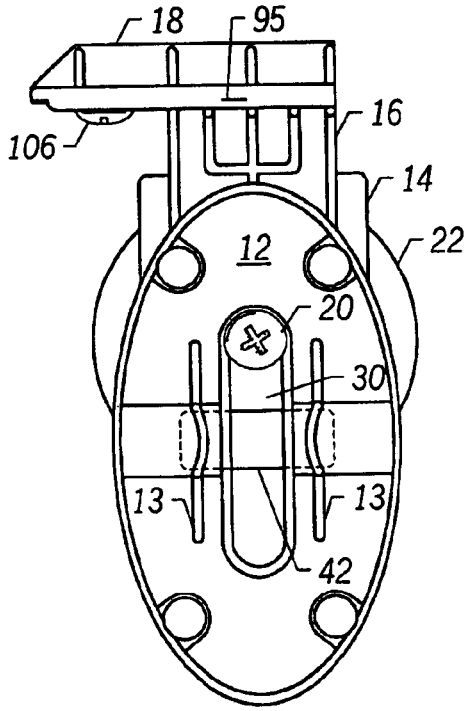
FIG. 12 is a bottom plan view of the cutting device of FIG. 11.
Figure 13:
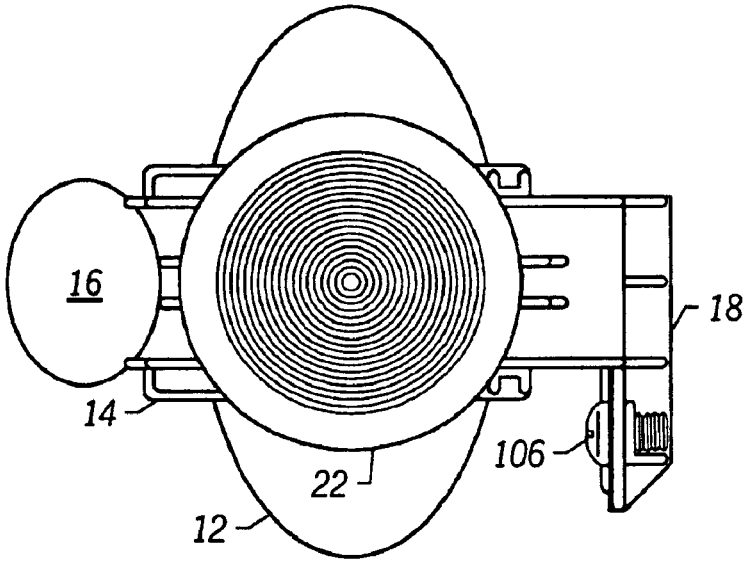
FIG. 13 a top plan view of the cutting device of FIG. 11 after it has been rotated 90 degrees.
Figure 14:
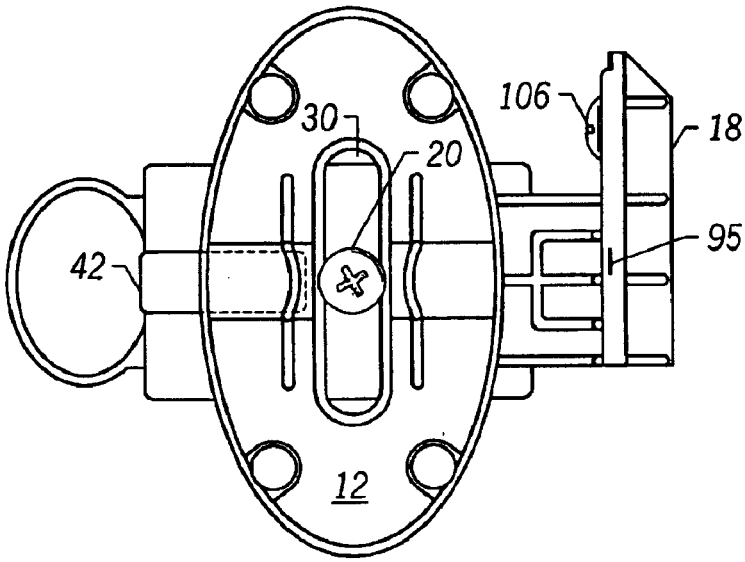
FIG. 14 a bottom plan view of the cutting device of FIG. 13.

FIGS. 11–14 show cutting device 10 when the spacer block 14 (and hence, adjusting plate 16) is in two different positions with respect to the base plate 12. In FIG. 11, the longitudinal axis 68 of slot 62 in adjusting plate 16 (see FIG. 7) is substantially aligned with the major axis of the base plate ellipse. FIG. 12 shows that in this position, the slider block 42 is in a center position within channel 38, while the enlarged portion of fastener 20 is at the extreme end of slot 30. When the knob is rotated clockwise for a quarter turn, the cutting device 10 is now in a position as shown in FIG. 13, where the longitudinal axis 68 of slot 62 in adjusting plate 16 is substantially aligned with the minor axis of the base plate ellipse. FIG. 14 shows that in this position, the slider block 42 has moved to one extreme of channel 38, while the enlarged portion of fastener 20 has moved to a position in the center of slot 30. Because the spacer block 14 (and hence, adjusting plate 16) are captivated together using a suitable connecting mechanism, the first pivot point slides along the slot 30 while the second pivot point slides along the channel 38, thereby causing spacer block 14 to rotate and slide in an elliptical pattern with respect to base plate 12.

Operation of the oval cutting device 10 will now be described with respect to FIGS. 17–20. We assume that the cutting device is positioned in an initial cutting position on a sheet of material with the resilient feet 48 in contact with an upper surface of the sheet. The view of FIGS. 17–20 is from the upper surface of the sheet looking up as the device is rotated to form an ellipse in the sheet of material. The base member 12 is preferably oval-shaped and includes an elliptically-shaped outer periphery that is preferably substantially parallel to an oval to be cut. The shape of the base member 12 greatly facilitates initial placement and alignment of the cutting device 10 on the sheet of material to be cut. In addition, the ellipse-shaped base member 12 includes index marks 172 that identify the major axis of the ellipse, and index marks 174 that identify the minor axis of the ellipse. Index marks 172 and 174 make placement of the cutting device on a sheet of material easier by identifying the axes of the ellipse, which can then be visually aligned with the sheet to be cut.

Figure 15:
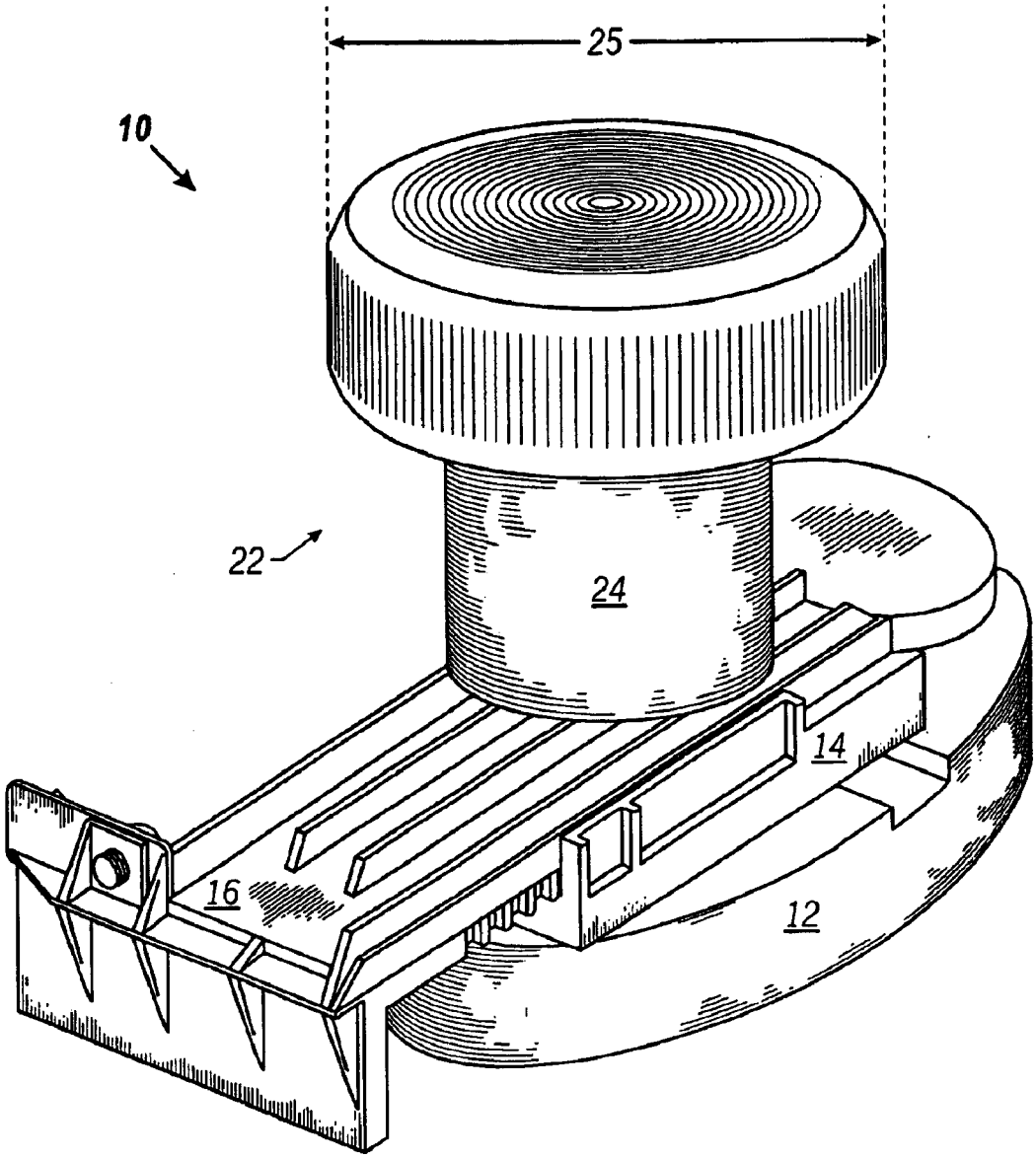
FIG. 15 is a perspective view of the cutting device of FIGS. 1 and 2.
Figure 16A:
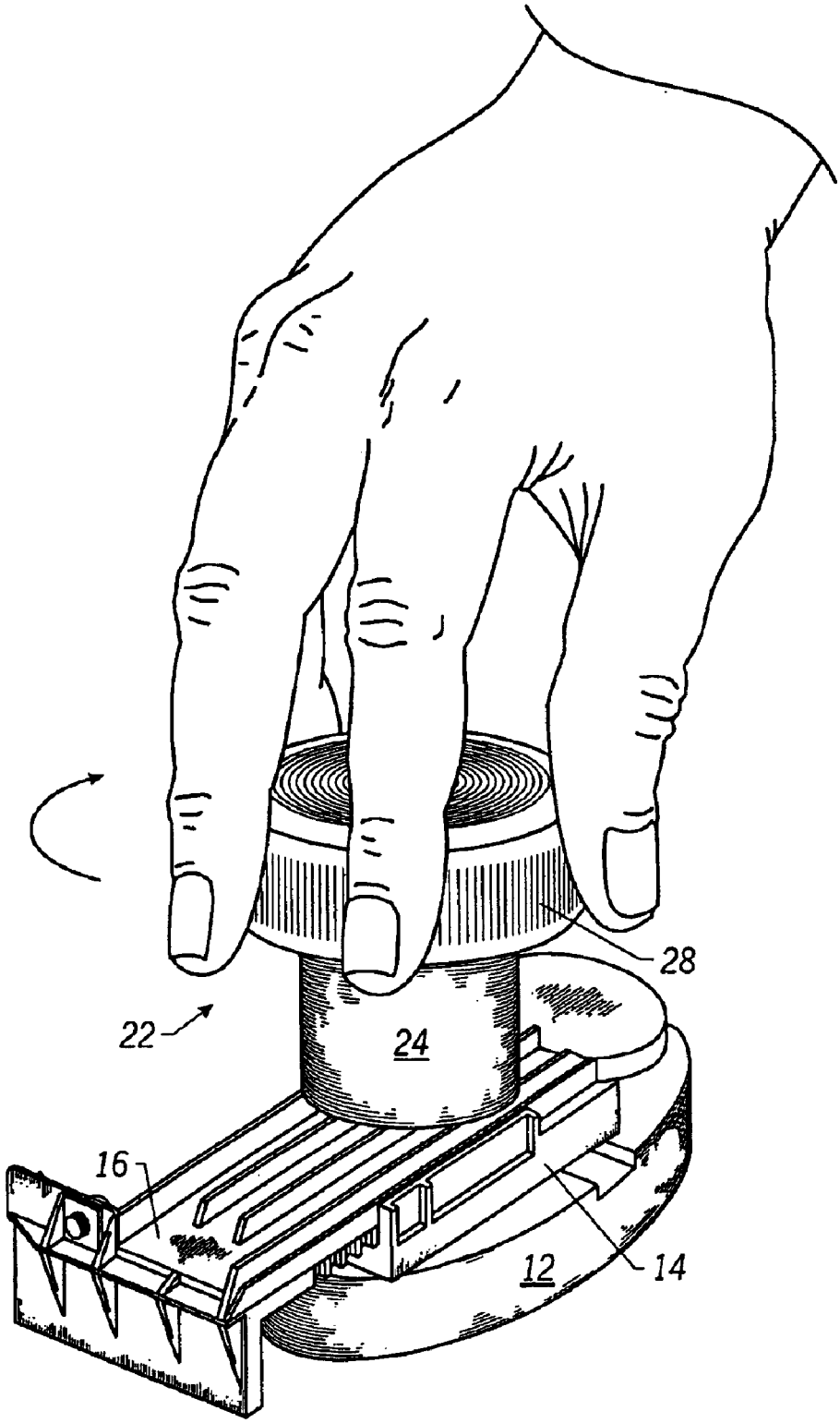
FIGS. 16A and 16B each show different finger placement for a user to rotate the knob of the cutting device in accordance with the preferred embodiments.
Figure 16B:
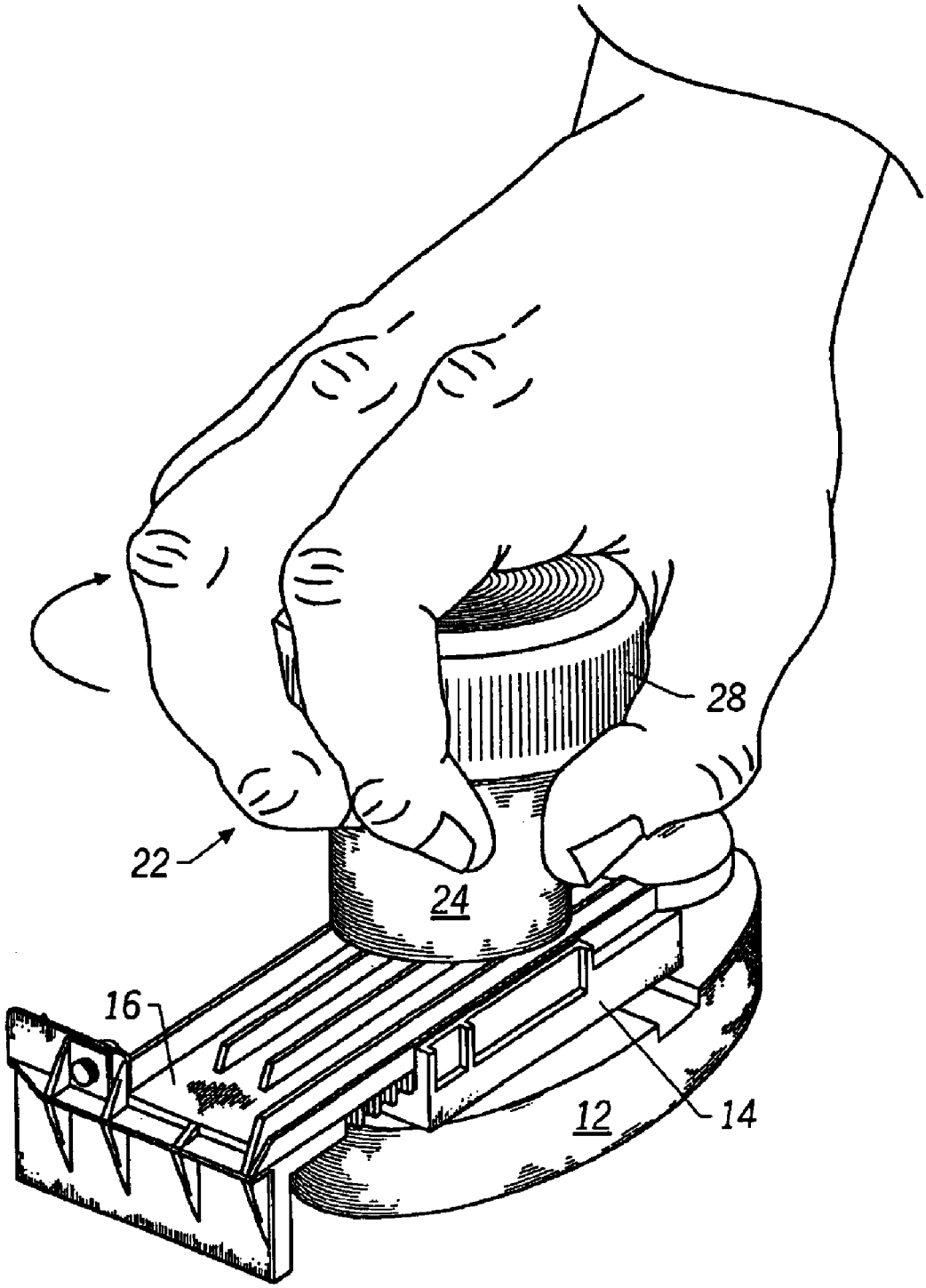
Figure 17:
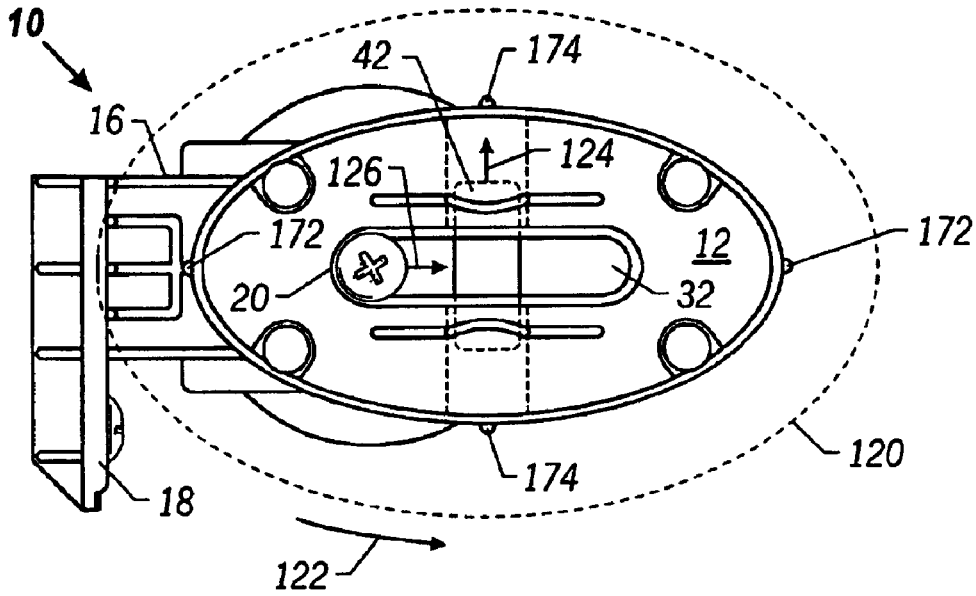
FIG. 17 is a bottom plan view of the hand-held oval cutting device at a first cutting position.

The adjusting plate 16 can be adjusted to cut an oval of a predetermined dimension, as previously described. As shown in the drawings, we assume that the screw 20 is fixed with respect to the slot 62 (see FIG. 7) midway between the ends of the slot 62 to define a medium size oval to be cut. After setting the proper oval size and positioning the device 10 on the sheet, the knob 22 is then grasped in one hand by a user and pressed downwardly to maintain the position of the device 10 on the sheet. Simultaneously, the knob is rotated in a direction as shown by arrow 122. Two possible hand positions on the device are shown in FIG. 16 to illustrate that there are many different ways to rotate the knob 22 to effect the cutting motion. In FIG. 16A, a user extends the fingers of one hand and grasps the outer edges of the upper portion 28 of handle 22 such that all fingers and the thumb of one hand contact the knob 22. A simple twist of the wrist rotates the knob, which causes the device to cut an oval shape, as described in more detail below. In an alternative grip, the person's hand is positioned so the top portion of knob 22 rests on a portion of the user's palm, with the thumb and two or more fingers wrapped around the upper portion 28 and extending into the area of the reduced portion 24 of knob 22. This grip is similar to the way a person might grasp a doorknob. Referring to FIG. 15, to effect proper rotation of knob 22, which is coupled to spacer block 14 and adjustment plate 16, the diameter 25 of knob 22 is preferably more than one inch, is more preferably between one and three inches in diameter, and is most preferably approximately two inches in diameter. This size allows easily gripping the knob with a human hand to effect rotation of the knob and thereby form an elliptical shape in the sheet of material in a smooth, one-handed motion.

Referring back to FIGS. 17–20, during rotation from the FIG. 17 position to the FIG. 18 position, the slider block 42 moves in a direction represented by arrow 124 from a central portion of the channel of the base member 12 to an upper end of the channel. Simultaneously, the screw 20 slides in the slot 32 of the base member 12 in a direction represented by arrow 126 from a first end of the slot 32 to a central portion of the slot 32, and simultaneously rotates in the direction 122. The mutual position of the screw 20 and slot 62 do not change during movement since they are fixed together by the knob 22, as is evident from FIGS. 3A, 3B and 15. Thus, the screw 20 functions as a first movable pivot point for the spacer block/adjusting plate combination (and attached blade holder 18 and blade 92). Sliding movement of the slider block 42 in the channel 38 and simultaneous rotation of the spacer block 14 about the pivot point of the slider block 42 defines a second movable pivot point about the aperture 15 in spacer block 14. Mutual movement of the first and second pivot points causes elliptical movement of the blade 92 along the path 120. The distance between the first and second pivot points is maintained during the elliptical movement. The distance between the pivot points and the cutting tip 96 can be adjusted when not cutting by loosening the knob 22 and locating the extended portions 17 in a different set of recesses 72, as previously described.

Figure 18:
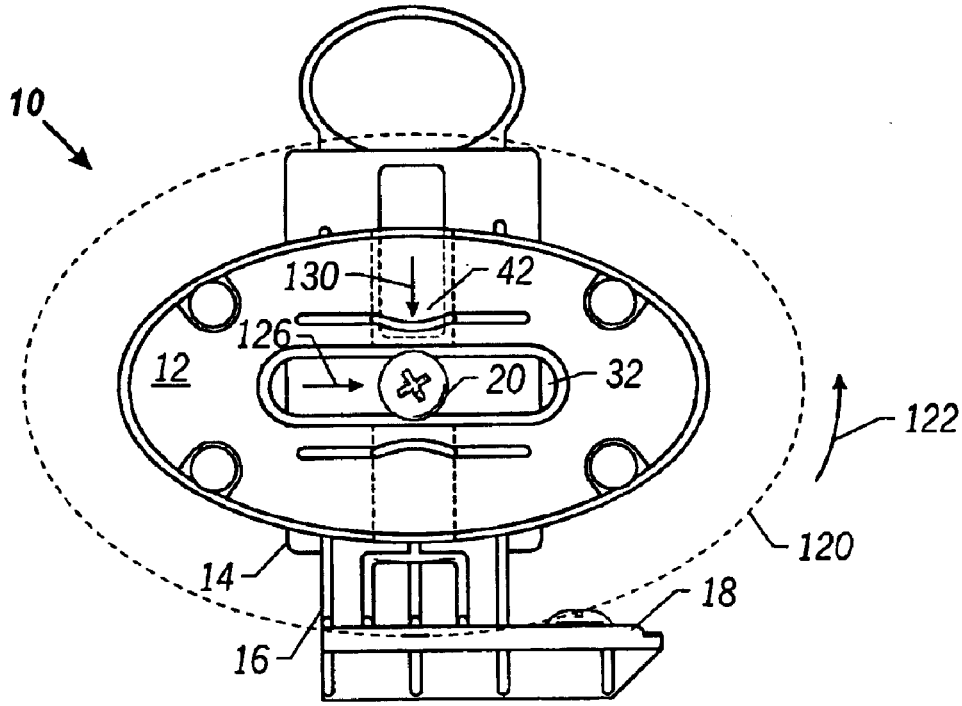
FIG. 18 is a bottom plan view of the hand-held oval cutting device at a second cutting position.
Figure 19:
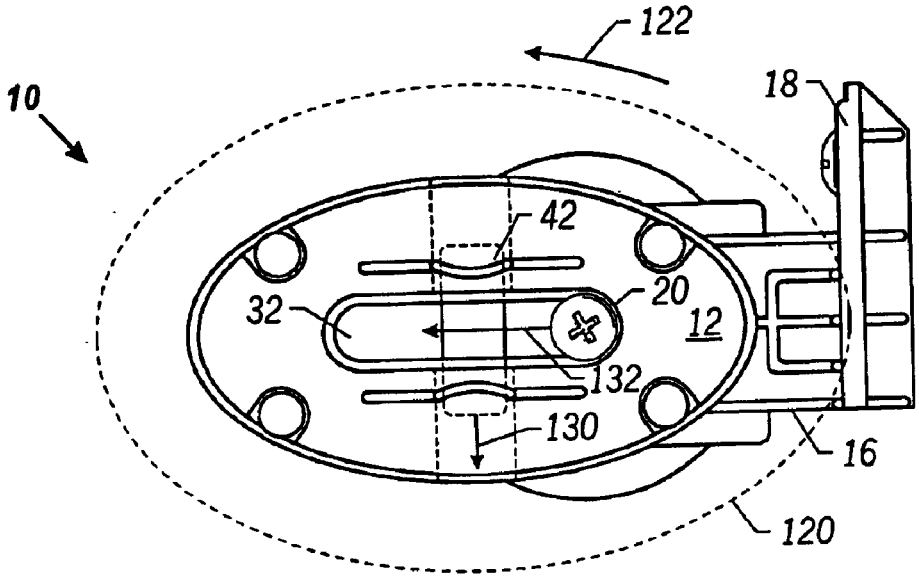
FIG. 19 is a bottom plan view of the hand-held oval cutting device at a third cutting position.

Continued rotation of the spacer block 14 about the aperture 15 in spacer block 14 from the FIG. 18 to the FIG. 19 position causes the slider block 42 to move in a direction represented by arrow 130 from the upper end of the channel position to the central channel portion. Simultaneously, the screw 20 slides in the slot 32 of the base member 12 in the direction 126 from the central slot portion to a second end of the slot opposite the first slot end.

Figure 20:
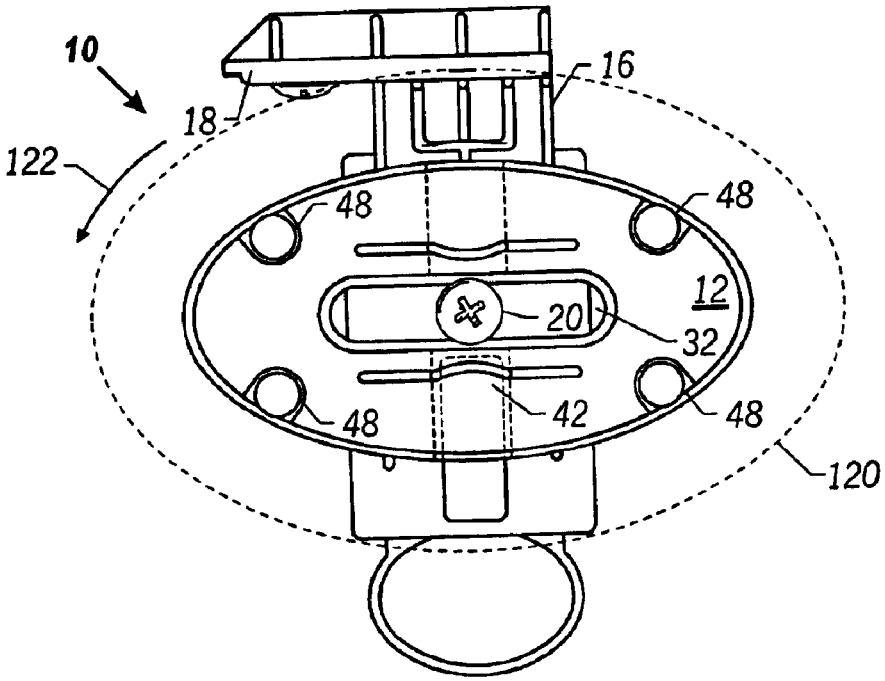
FIG. 20 is a bottom plan view of the hand-held oval cutting device at a fourth cutting position.

Likewise, continued rotation of the spacer block 14 about the aperture 15 in spacer block 14 from the FIG. 19 to the FIG. 20 position causes the slider block 42 and slider 42 to move in the direction 130 from the central channel portion to a lower end of the channel. Simultaneously, the screw 20 slides in the slot 32 of the base member 12 in a direction represented by arrow 132 from the second channel end back to the central channel portion. Continued rotation of the spacer block to the FIG. 17 position completes the cut and places the slider block, pivot pin and screw 20 in their original positions. Thus, oval shapes can be cut in a sheet of material through smooth, continuous action from one-handed manipulation of the knob.

Although clockwise rotation of the slider block 14, and hence the attached adjusting plate 16 and blade holder 18 is preferred for right-handed use, the blade 92 can be set for counter clockwise rotation if desired, which is preferable for left-handed use. Moreover, although the cutting device 10 is intended primarily for cutting ovals in photographs, cardboard sheets and the like, the blade holder can be adapted to receive other cutting implements for ceramic, glass, wood, etc., or can be modified within the scope of the preferred embodiments to receive standard drawing implements.

Figure 21:
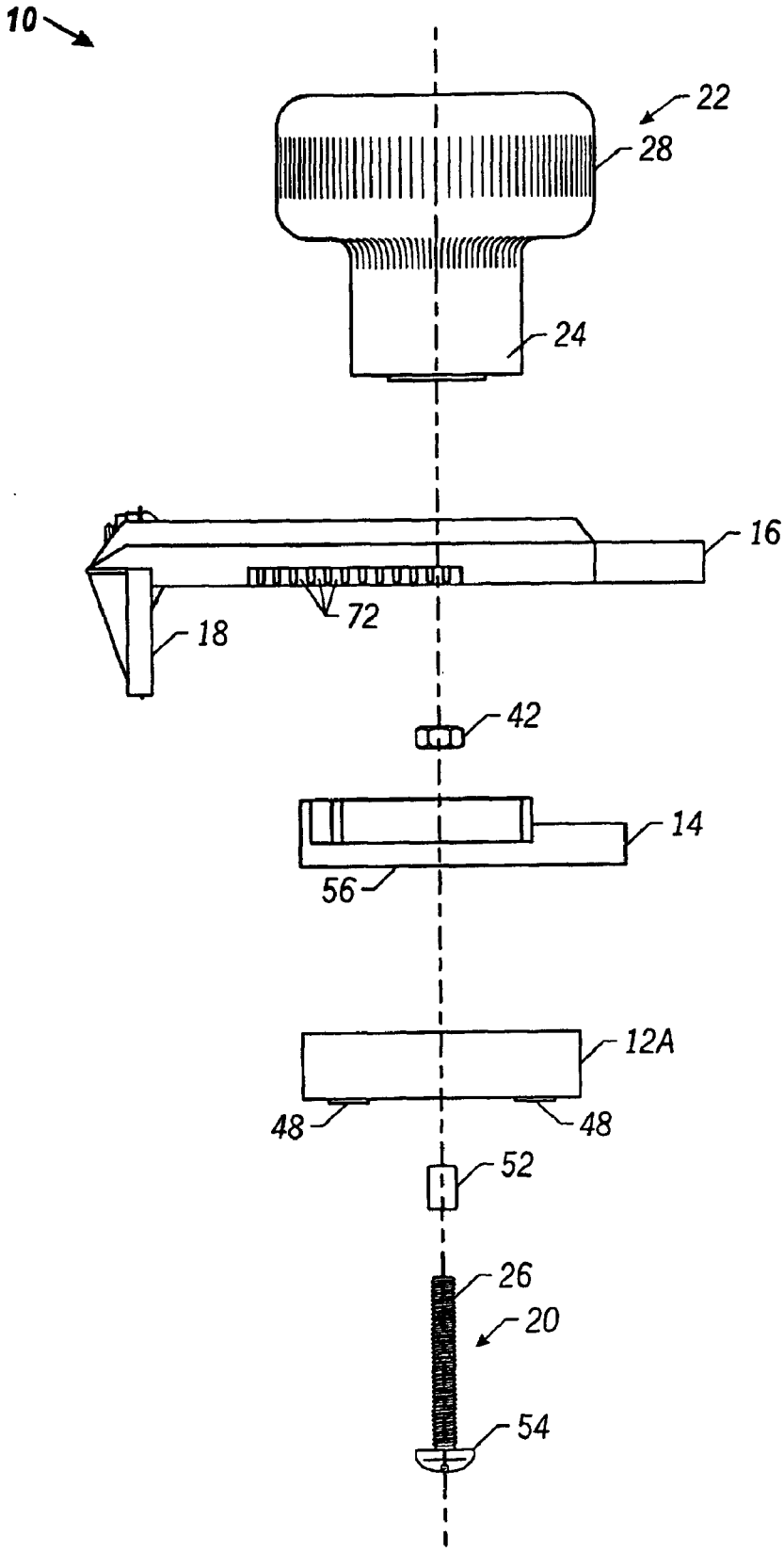
FIG. 21 is an exploded side view of a hand-held circle cutting device in accordance with a second embodiment of the invention.
Figure 22:
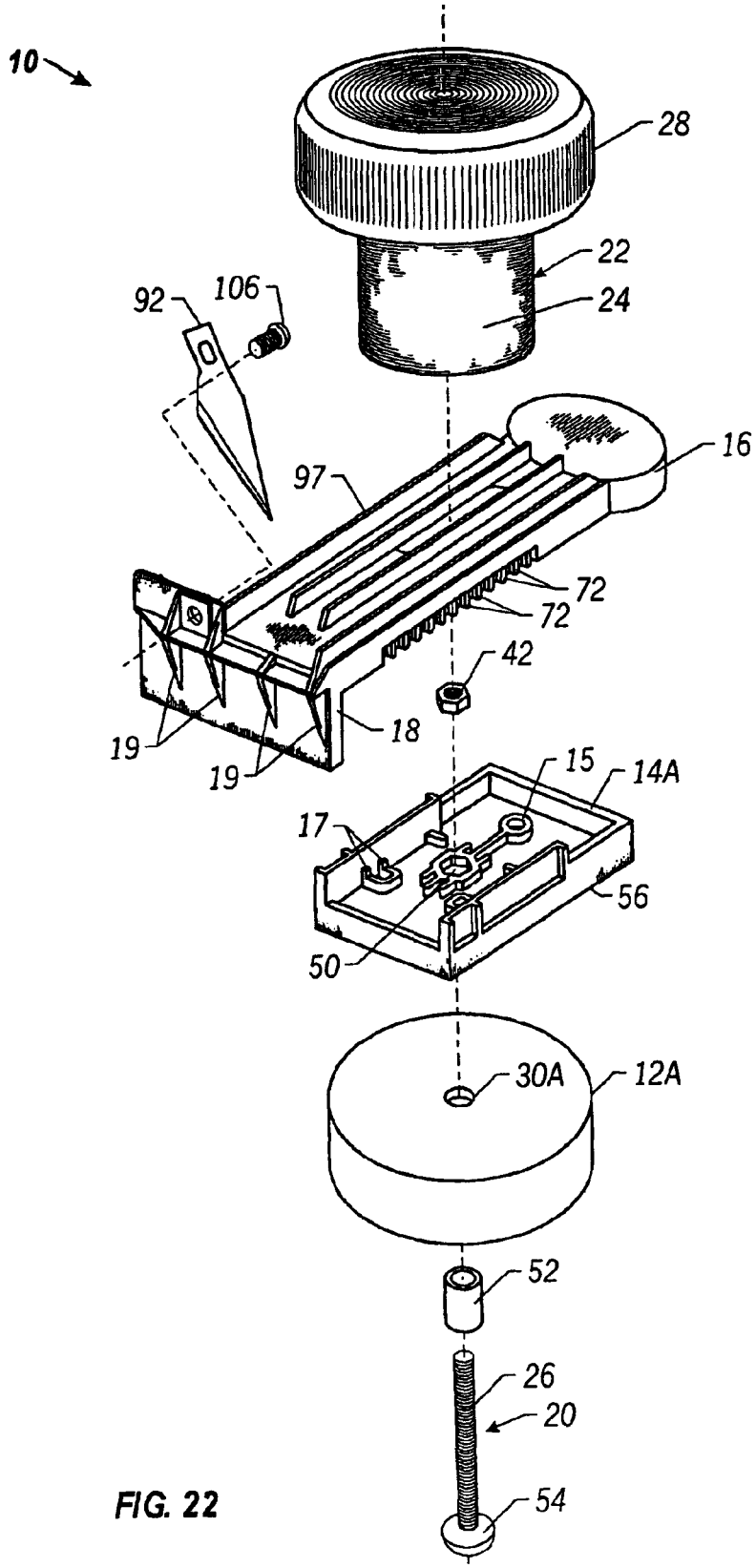
FIG. 22 is an exploded perspective view of the hand-held circle cutting device of FIG. 21.

A circle cutter in accordance with the second embodiment is shown in FIGS. 21 and 22. The same knob 22, adjusting plate 16, nut 42, spacer block 14, spacer 52, and screw 20 may be used as is used in the oval cutting device in FIGS. 1–20, described above. However, spacer block 14A is shown without the aperture 15 that made up the second pivot point in the oval configuration, because no second pivot point is needed for a circle cutter. To make a circle cutter, a circular base plate 12A with a circular opening 30A is used instead of the elliptical base plate 12. The diameter of opening 30A is preferably large enough to receive the threaded portion 26 of screw 20, yet smaller than the outside dimension of spacer 52. This configuration assures that spacer block 14A will slide atop the circular base plate 12A when the screw 20 is tightened into nut 42. Note that circular base plate 12A suitably includes index marks 176 along two diameters that intersect at right angles to help in aligning the circle cutter on the sheet of material.

In this circle cutter configuration, note that the same adjusting plate 16 may be used to generate circles of various sizes by selectively positioning the adjusting arm in a desired position with respect to the spacer block 14A, and tightening the knob 22 to hold the extended portions 17 of spacer block 14A within a selected set of recesses 72 on the adjusting plate 16. The circle cutter in accordance with the second embodiment allows one-handed operation while cutting circles of various sizes, which is a great improvement over the two-handed operation of known circle cutters in the art.

In the preferred embodiments, the base plate 12, spacer block 14, and adjustment arm 16 are made of a clear plastic material that allows a person to see the sheet of material under the base plate 12. The preferred manufacturing technique is injection molding, which allows the various features of each piece (including stiffening ribs) to be formed at the same time by injecting heated liquid plastic into a mold. Once the plastic cools, the parts are removed from the mold, and the process continues. Note that other variations and methods of manufacture for manufacturing the cutting device, whether now known or developed in the future, are expressly within the scope of the preferred embodiments.

While particular embodiments of the invention have been shown, it will be understood that the invention is not limited thereto since modifications may be made by those skilled in the art, particularly in light of the foregoing teachings. For example, the particular oval shape with its present major and minor axes can be changed by adjusting the relative dimensions of one or more of the described components.

What is claimed is:

1. A hand-held device for forming a circular shape in a sheet of material, the device comprising:

a first member having an upper surface and a lower surface, the lower surface adapted to contact the sheet of material, the first member having an opening of a first size extending through the first member;

a second member having a lower surface that is at least partially in contact with the upper surface of the first member and having a first opening extending there through;

an adjusting plate slidably connected to the second member to allow relative motion between the adjusting plate and the second member, the adjusting plate having an elongated opening there through;

a connecting mechanism coupled to the second member and extending through the first member opening, the second member opening, and the adjusting plate enlongated opening, the connecting mechanism including an enlarged portion that is larger than the first member opening, thereby captivating the second member in a rotatable relationship with respect to the first member about a first pivot point defined by the connecting mechanism and rotatably and slidably captivating the adjusting plate;

a knob coupled in a fixed position with respect to the second member and substantially aligned with the first pivot point, the knob having a size and shape that allow grasping the knob with one hand such that rotation of the knob causes the second member to slide atop the first member to form the shape in the sheet of material.

2. The device of claim 1 wherein the opening in the first member comprises a circular opening, and wherein the shape comprises a circle.

3. The device of claim 1 wherein the second member comprises a forming member for forming the circular shape in the sheet of material.

4. The device of claim 1 wherein the second member is coupled to a forming member that forms the circular shape in the sheet of material as the second member slides atop the first member.

5. The device of claim 4 further comprising an adjustment mechanism operatively connected between the second member and the forming member that allows the forming member to be placed in a plurality of positions with respect to the second member for selectively forming different sizes of circular shapes.

6. The device of claim 1 further comprising a cutting blade operably connected to the second member and adapted for contacting the sheet of material for cutting a circular shape therein as the knob is rotated.

7. The device of claim 6 wherein the second member comprises a blade holder, the cutting blade being removably mounted to the blade holder.

8. The device of claim 7 wherein the blade holder comprises a recess that is shaped to receive a substantial portion of the blade, a depth of the recess being at least equal to a thickness of the blade.

9. The device of claim 8 further comprising a fastener mounted to the blade holder, the fastener having a head portion, with the head portion of the fastener being located in the recess such that a space for the blade is formed between the head portion and a bottom surface of the recess, such that the blade can be securely held between the head portion of the fastener and the bottom surface of the recess.

10. The device of claim 1 further comprising an instrument operably connected to the second member and adapted for contacting the sheet of material for forming the circular shape as the knob is rotated.

11. The device of claim 10 wherein the instrument is a cutting member for cutting the circular shape in the sheet of material.

12. The device of claim 1 wherein the first member has a circular shape, wherein the first member further comprises index marks that identify two perpendicular diameters on the first member to facilitate the alignment of the first member on the sheet of material.

13. The device of claim 1 wherein the first member comprises resilient feet that contact and hold the sheet of material in a fixed position with respect to the first member as the knob is rotated without damaging the sheet of material.

14. A hand-held device for cutting a circular shape in a sheet of material, the device comprising:

a first member having an upper surface and a lower surface, the lower surface including a plurality of resilient feet, the first member having a substantially circular opening of a first size extending through the first member;

a second member having a lower surface that is at least partially in contact with the upper surface of the first member;

a forming member coupled to the second member that forms the circular shape in the sheet of material as the second member slides atop the first member, wherein the forming member comprises a blade holder that holds a cutting blade;

an adjustment mechanism operatively connected between the second member and the forming member and disposed between the second member and the knob that allows the forming member to be placed in a plurality of positions with respect to the second member for selectively forming different sizes of circular shapes;

a connecting mechanism coupled to the second member and extending through the first member opening, through the second member and engaging the knob, the connecting mechanism including an enlarged portion that is larger than the first member opening, thereby captivating the second member and the knob in a rotatable relationship with respect to the first member about a first pivot point defined by the connecting mechanism; and a knob coupled in a fixed position with respect to the second member and substantially aligned with the first pivot point, the knob having a size and shape that allow grasping the knob with one hand such that rotation of the knob causes the second member to slide atop the first member to form the shape in the sheet of material, wherein rotation of the second plate member with respect to the first plate member about the pivot point causes the forming member to move in a circular path.

15. A hand-held device for forming a circular shape in a sheet of material, the device comprising:

a first member having an upper surface and a lower surface, the lower surface adapted to contact the sheet of material, the first member having an opening of a first size extending through the first member;

a second member having a lower surface that is at least partially in contact with the upper surface of the first member;

a connecting mechanism coupled to the second member and extending through the first member opening, the connecting mechanism including an enlarged portion that is larger than the first member opening, thereby captivating the second member in a rotatable relationship with respect to the first member about a first pivot point defined by the connecting mechanism;

a knob coupled in a fixed position with respect to the second member and substantially aligned with the first pivot point, the knob having a size and shape that allow grasping the knob with one hand such that rotation of the knob causes the second member to slide atop the first member to form the shape in the sheet of material; and the second member comprising a blade holder, a cutting blade being removably mounted to the blade holder, the cutting blade operably connected to the second member and adapted for contacting the sheet of material for cutting a circular shape therein as the knob is rotated;

wherein the blade holder comprises a recess that is shaped to receive a substantial portion of the blade, a depth of the recess being at least equal to a thickness of the blade.

16. The device of claim 15, further comprising a fastener mounted to the blade holder, the fastener having a head portion, with the head portion of the fastener being located in the recess such that a space for the blade is formed between the head portion and a bottom surface of the recess, such that the blade can be securely held between the head portion of the fastener and the bottom surface of the recess.

* * * * *